United States Patent [19]

Garrett, Sr. et al.

[11] 4,093,141

[45] June 6, 1978

[54] RECOILER SPACER SHOOTER

[75] Inventors: Richard H. Garrett, Sr.; Yale M. Feniger, both of Toledo, Ohio

[73] Assignee: Coil Tite, Inc., Toledo, Ohio

[21] Appl. No.: 802,721

[22] Filed: Jun. 2, 1977

[51] Int. Cl.[2] ..... B65H 19/04

[52] U.S. Cl. ..... 242/56.9; 242/56.2; 242/78.1

[58] Field of Search ..... 242/78.1, 56.2, 56.4, 242/56.7, 56.9, 67.2, 67.3 R

[56] References Cited

U.S. PATENT DOCUMENTS

| | | | |
|---|---|---|---|
| 2,935,273 | 5/1960 | Hoeffgen | 242/56.9 |
| 3,871,594 | 3/1975 | O'Neil | 242/78.1 |
| 3,991,952 | 11/1976 | Altman | 242/78.1 |

*Primary Examiner*—Edward J. McCarthy
*Attorney, Agent, or Firm*—Hugh Adam Kirk

[57] ABSTRACT

A remotely controllable device for shooting fiberboard spacers, one at a time, between a selected slit web or strip and its coil, which strip is slit with other strips from a wider sheet or web. The shooting device is horizontally pivoted on a carriage movable along a boom, which boom is swingable about a vertical axis into and out of position under the strips or slit webs being recoiled. The device contains a magazine for storing a plurality of fiberboard spacers which are selectively fed between fast rotating rollers that shoot the spacers between the strip and its coil thereof. A control panel is provided for raising and lowering the spacer projecting end of the device to correspond with the increased diameter of the rewound strip coils, and to move the device along the boom across the parallel strips to select the strip or strips that are sagging and require spacers to make them taut as the other strips are taut as these strips are simultaneously wound on a common mandrel of the recoiler. The projecting end of the device may be provided with a beam of light for indicating its position with respect to each strip coil requiring a spacer. Also when coils are being changed, the device and its boom may be swung out of position, from between the splitter and the recoiler, about a vertical post located on one side of the split webs or strips.

16 Claims, 4 Drawing Figures

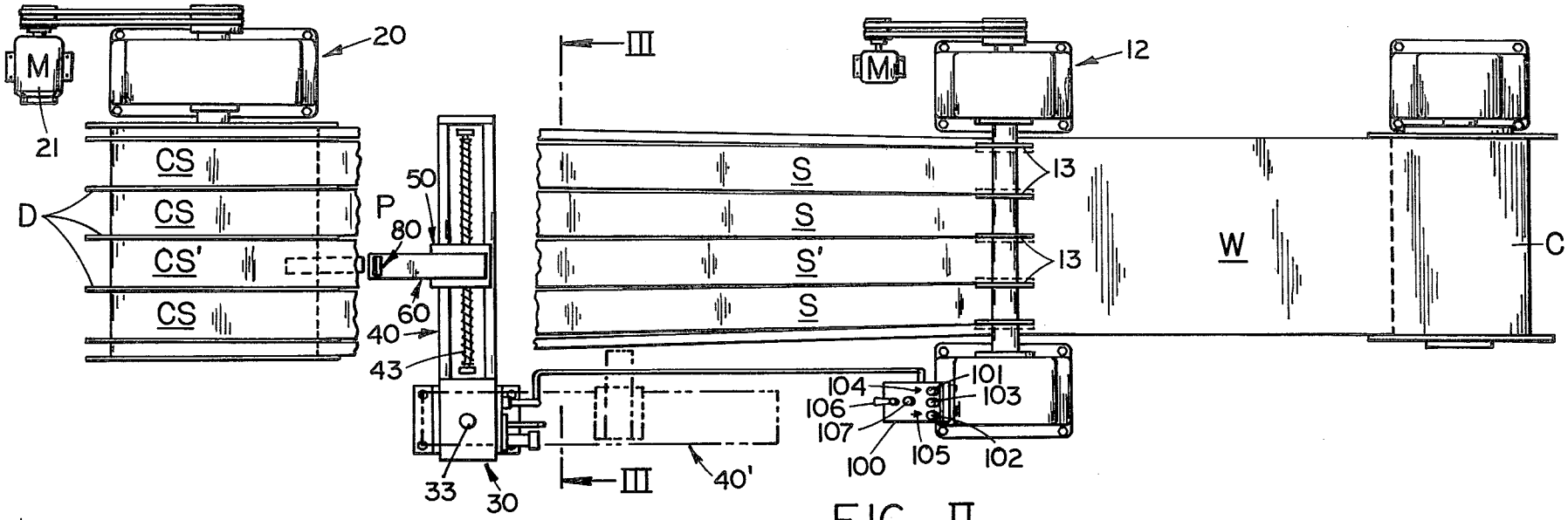
FIG. II
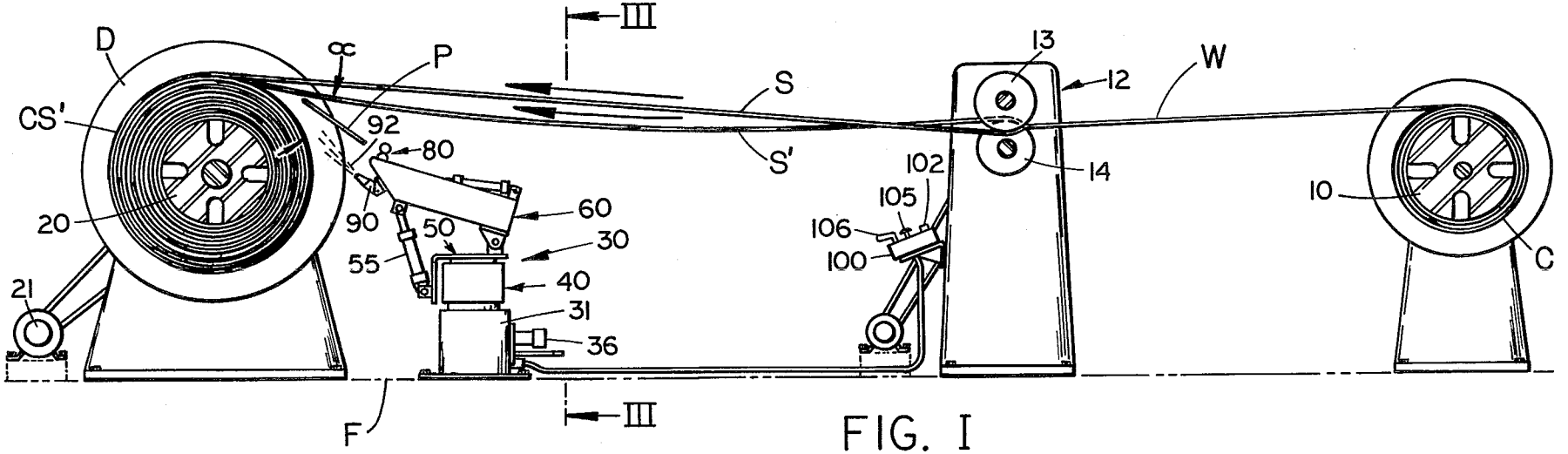
FIG. I

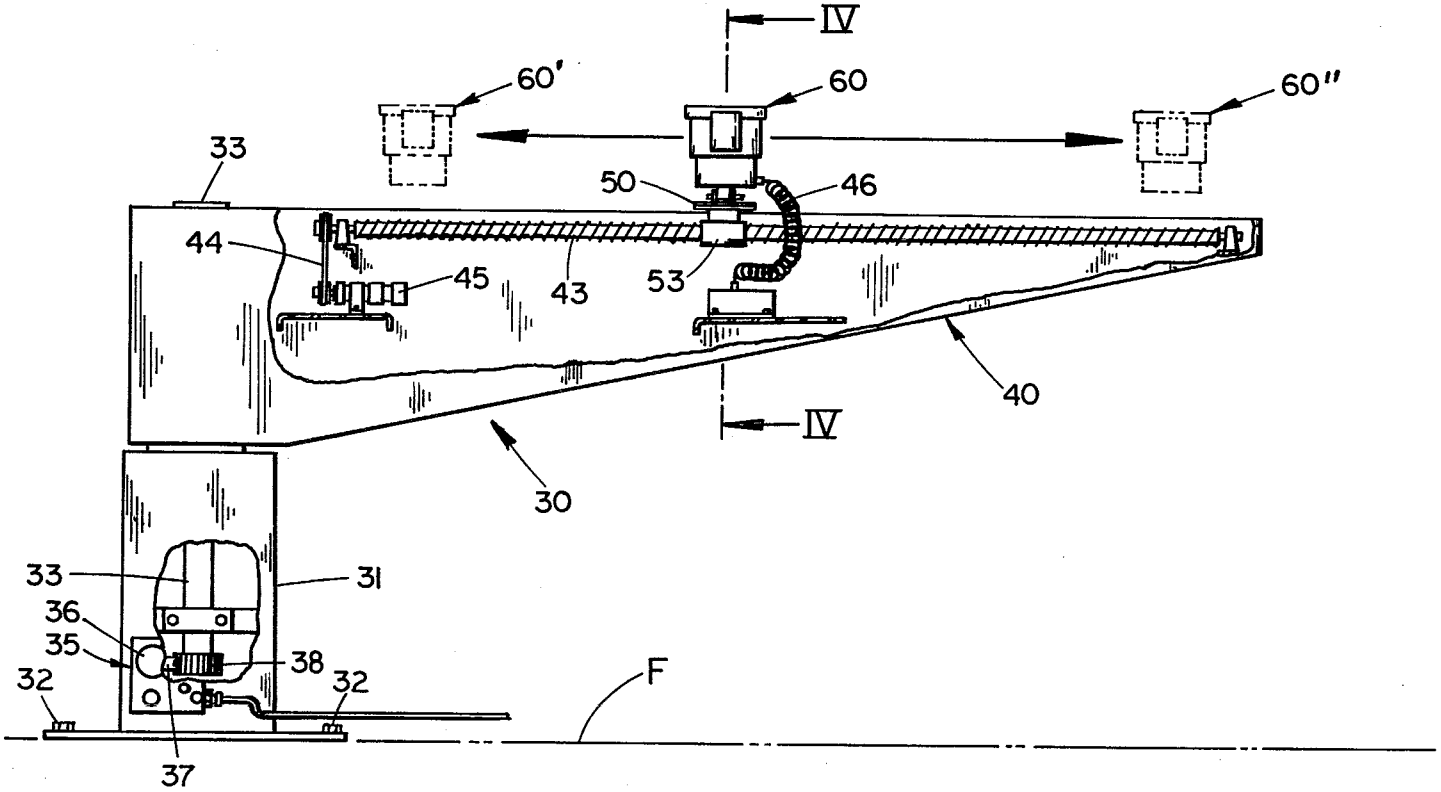
FIG. III

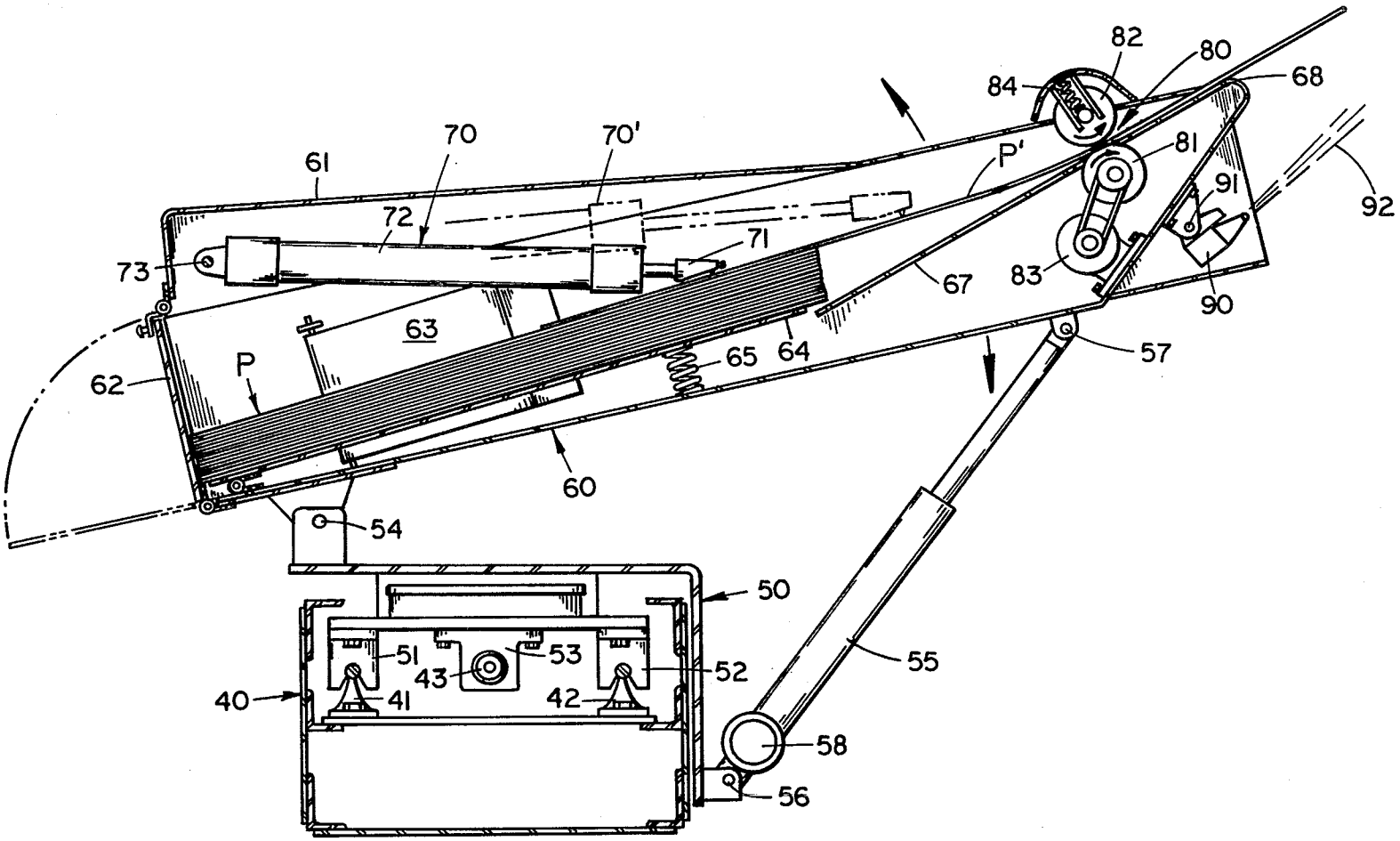
FIG. IV

RECOILER SPACER SHOOTER

BACKGROUND OF THE INVENTION

In slitting wide webs, sheets or coils of metal, such as steel, into strips, the sheet is passed through a plurality of cutters to simultaneously produce a plurality of strips which are immediately rewound simultaneously as separate coils on a mandrel. Since the wide web or coil sheet often varies slightly in thickness, after slitting some of the coils, particularly those from the edges of the sheet, where the sheet is usually thinnest, will have their strips from the slitter sag with respect to the other strips and thereby will not be wound as tightly as they should be, or as required by the purchaser of the coiled strips. Thus, in order to insure that all of the slit webs are coiled simultaneously and tautly, one to two foot length spacers of cardboard or other fiberboard which have been precut to about the width of the slit webs or slightly less, are fed into the strip coils when they need them to take up any slack or sag.

Previously the operator of such a slitter had a stack of such precut fiberboard spacers beside him so that he could manually insert these spacers under the fast coiling strips that sagged more than others so that all the rewound coils of strips would be tight. Since these spacers are quickly and tenaciously grabbed between the tangential strip and its coil already on the mandrel, if the operator did not release the spacer immediately, his hand could be quickly pulled into the fast winding coil and serious injury occur. To avoid this, some operators tended to throw the spacers between the strip and its coil, but the accuracy of this was not as great as when the spacers were fed directly to the split web which needed them.

Some mechanical devices have been made for feeding these spacers into these strip coils, which devices are mounted on tracks transverse of the strips, and were manually positioned by the operator from the side of the strips. Such spacers were stored as a continuous strip in a coil and then were cut to length by the device for feeding into the slit web coil, making these devices quite complicated.

Another way of taking up the slack or sag in coils was to coat the sagging strip with a powdered material to increase their thickness.

SUMMARY OF THE INVENTION

The recoiler spacer inserter or shooter according to the present invention, is mounted on a permanent vertical base or post which may be bolted to the floor at one side of the web between the slitter and the recoiler mandrel. Mounted on this post is a boom which is swingable to and from a position completely across and underneath the width of the slit strips, by a motor mechanism of gears, rack and pinion, or hydraulic cylinder.

Mounted on this boom is a carriage which is movable back and forth from one end of the boom to the other, or one side of the slit strips to the other, such as by a chain, worm, or other drive means. This carriage may be guided by tracks along the boom, and has mounted on one side thereof a horizontally pivoted spacer-carrying shooter device, the axis of which pivot is parallel to the movement of the carriage along the boom. Along the opposite side of the carriage and connected to the free or unpivoted side or end of the shooter device, is a motor means for raising and lowering the free end of the shooting device with respect to the carriage around its hinged or pivoted axis so as to point the spacer shooting device into the angle between the tangent of the strip and the circumference of its coil being wound from that strip on the recoiler. Thus, when the spacer is shot thereat it will be grabbed, pinched and wrapped around the recoiled strip.

The shooter device itself comprises a magazine or place for storing a plurality or stack of precut spacers that are to be projected one at a time into the recoiled strips. The magazine is provided with resiliently movable sidewalls for fitting different width spacing strips; for example from about 1½ to 6 inches wide, which are the usual widths of strips slit from steel webs, and from about 10 inches to about 2 feet in length. If more than one spacer is needed, additional spacers may be projected into the same strip coil until the sag in its feed strip is completely taken up. The magazine also has a resiliently movable bottom to urge the pile or stack of spacers toward the feeding mechanism.

The feeding mechanism comprises a reciprocating claw which engages the upper surface of the upper spacer at an acute angle, and feeds it between two rollers, one of which is driven rapidly by a motor, and the other of which is spring-urged into engagement with the driven roller for pinching the spacer to insure its frictional contact with the driven roller. These rollers are driven fast enough to project the spacer out of the free end of the spacer shooting device at a sufficient speed so as to be thrown into the direction of the apex of the angle between the fed strip and wound strip coil so the winding strip will grab and/or pinch the spacer and wind it into the strip coil.

In order to aid in the positioning of the shooter and particularly its spacer ejecting end thereof, there is provided adjacent this end, such as underneath the spacer projecting aperture or slot, a light source which throws a light beam onto the strip coil and into the angle between the coil and its fed strip so that the proper sagging fed strip and its coil and feeding angle can be easily selected for positioning and then triggering the spacer shooter.

A control box is provided for controlling all of the motions of this spacer shooting device, which control box may be situated adjacent the operator of the slitter so that he need take no time away from his controls of the slitter for manual positioning and/or operation of the spacer shooter. This control box is provided with lights, "on" and "off" buttons, and forward and reverse switches for moving the shooter back and forth along the boom and for raising and lowering the shooter. The control panel is also provided with a button that once the shooter is aligned, a quick push of the button will cause the reciprocating claw above the magazine to eject the top spacer into the rollers which immediately eject or shoot the spacer between the strip and its coil. After the recoiling operation is completed, another reversing switch is provided which will swing the whole beam mechanism out from the path of the web between the slitter and the recoiler so that easy access can be had for refeeding the next coil to be slit.

BRIEF DESCRIPTION OF THE VIEWS

The above mentioned and other features, objects, and advantages, and a manner of attaining them are described more specifically below by reference to an embodiment of this invention shown in the accompanying drawings, wherein:

FIG. I is a side elevation of a coil splitter showing one embodiment of a spacer shooter according to this invention, shooting a spacer into a recoiling strip that is sagging;

FIG. II is a plan view of the splitter shown in FIG. I with a portion of the strips broken away to show the spacer shooter, and showing in dotted lines the out-of-the-way position of the shooter and its boom;

FIG. III is an enlarged view taken along lines III—III of FIG. I or II with parts broken away and showing in dotted lines the carriage in its two extreme positions; and FIG. IV is a further enlarged vertical sectional view along lines IV—IV of FIG. III showing the carriage beam and the shooter device, and also showing in dotted lines the spacer feeder claw extending and feeding a spacer between its shooting rollers.

DETAILED DESCRIPTION OF PREFERRED EMBODIMENT

A. The Coil Slitter

Referring first to FIGS. I and II, there is shown a wide coil C of steel or the like mounted on a mandrel 10, the web W of which coil C is being unwound through a slitter 12 which may comprise pairs of spaced cutting discs 13 and 14 for cutting the web into strips S and S' which are being wound on a driven mandrel 20 which may be driven by an electric motor 21 and on which mandrel 20 each of the separate rewound coil strips CS may be separated by discs D. The normal operation of this slitter is that the coil C to be split is fed between the driven slitter cutting discs 13 and 14, and then the cut strips S and S' from the web W are wound on the driven mandrel 20, preferably between discs D which separate the coil strips CS and also tends to spread the strips S slightly like a fan as they come from the slitter 12. This spreading, plus the fact that the thickness of the web W is not always uniform, usually being thinner on the edges than in the center because of the bowing of the rollers that produced it or rolled it, causes sagging of one or more of the strips S, such as the strip S', so that it is not wound taut on its coil CS' as are the strips S on their coil CS. Since it is important that all of the strips S in the coils CS are wound taut, previously, cardboard or paper spacers P were inserted between the strip S' and its coil CS' as the machine was operating at a high speed to expand the outer spiral of the coil CS' and take up the slack in the strip S'. In fact, a difference in thickness of the web W of one thousandth of an inch in a 6 foot diameter coil of steel will produce 1½ inches difference in the full length of the rewound coil CS' from that of the main coil C, causing a sag of as much as 7 inches in the strip S' below that of the other strips S. In view of the size, speed and strong gripping action of the strips S as they are wound in their coils CS, the insertion of the spacers P in the angle $\alpha$ between the tangent of the strip S' and its circumferential spiral or coil CS' is very dangerous, particularly if the one that inserts the spacer P does not let go of it in time, his fingers, arms and/or body can be quickly pulled into the coil CS' and very serious injury occur.

In order to avoid such injuries, applicants have invented a new and automatic mechanical device 30 for inserting these spacers P which can be easily controlled by the operator of the slitter from a control panel 100 that may be located adjacent the control panel for the slitter.

B. Spacer Shooter Device

This automatic electro-mechanical device 30 comprises a vertical post or column 31 which preferably is anchored to the floor F that supports the recoiler and splitter 10, 12 and 20, upon which vertical post 31 is mounted to a boom 40 along which travels a carriage 50 that supports a tiltable shooter device 60. This boom 40 may be swung out from under the strips S and S' into the dotted line position 40' shown in FIG. II so that it will be out of the way when a new web W is to be slit and fed into the slitter 12 and onto the recoiler 20. After the slitter has started operation, the boom 40 is swung back into its operative full line position shown in FIGS. I and II.

B-1. The Base Post

Referring now to FIG. III, the base or post 31 is herein shown anchored to the floor F by means of bolts 32 and the top of the post is provided with a vertical shaft 33 for supporting and journalling the oscillating boom 40. Attached to the lower part of the post there may be provided a motor mechanism 35 for oscillating the boom 40 with respect to the base 31 through an angle of at least 90° as shown between the full and dotted line positions in FIG. II mentioned above. This motor mechanism 35, although herein shown to comprise a pair of opposing air hydraulic cylinders 36 operating a rack 37 and gear 38 keyed to the shaft 33. These cylinders 36 also cushion the stopping of the oscillations of the boom 40 at its limiting position. Thus, the post 33 is oscillated by the reciprocating action of the rack 37 enmeshed with the ring gear 38 keyed to the bottom of the post 33.

B-2. The Boom

Referring to FIGS. III and IV, the boom 40 which is anchored to the oscillating vertical shaft or post 33, may be provided on its upper portion with a pair of tracks 41 and 42 (see FIG. IV) between which may be provided a worm or screw 43 journalled at opposite ends of the boom and driven by gearing 44 to a reversible electric motor 45 mounted on the boom 40. This worm 43 moves the carriage 50 supporting the spacer shooting device 60, along the boom 40 into the position shown in FIG. II for aligning it with the strip S' which is sagging and needs a spacer P. The control connections for the shooting device 60 are shown through the extensible helical conductor 46 between the center of the boom 40 and the carriage 50 and device 60. Other means than a screw 43 may be used for the moving of the carriage 50 and the spacer shooting device 60, such as for example a sprocket chain and/or a hydraulic or air cylinder means without departing from the scope of this invention.

B-3. The Carriage

Referring further to FIGS. III and IV, the carriage 50 is shown supported and guided by slides 51 and 52 on the tracks 41 and 42 respectively, and with a nut means 53 which engages the worm 43 for the positive movement of this carriage 50 along the rails 41 and 42 from one end of the boom 40 to the other, namely to and from its two limiting positions 60' and 60'' shown in dotted lines in FIG. III. In these limiting positions 60' and 60'' the boom 40 may be provided with limit switches (not shown) for stopping the motor 45.

Along one side of the carriage 50 there is provided a hinge or pivot means 54 which has an axis parallel to the boom 40 and mounts one end of the spacer shooting device 60. On the other side of the carriage 50 and herein shown depending from the upper surface thereof is provided an extendible and retractible link means 55 pivoted at 56 to the carriage 50 and at its opposite end 57 to the other outer oscillatible end of the shooter device 60. This extendible and retractible link 55 may be hydraulically or screw operated by means of a motor 58 mounted adjacent the pivot 56 on the carriage 50. Thus the outer end of the shooter device 60 may be raised or lowered as desired for pointing its spacer shooting outer upper end into bisecting the angle $\alpha$ shown in FIG. I. This raising and lowering enables this device 60 to compensate for the size of the coils CS as they increase in diameter as more of the strips S are wound thereon.

B-4. The Spacer Shooter

Referring now to FIG. IV, the device 60 comprises a housing 61 providing a magazine for a pile of spacers P which may vary in width from 1½ to about 6 inches, depending upon the widths of the strips S that are cut in the slitter 12. These spacers P are precut and stacked in the magazine section of the housing 61 adjacent the pivot 54 by opening the rear side 62. The internal parallel vertical side walls of the housing 61 may be provided with oppositely spring pressed plates 63 for engaging the sides of strips of different widths and maintaining them in the center of the magazine for easy engagement by the feeding mechanism 70. The bottom supporting plate 64 for the stack of spacers P is also preferably spring urged by means of a spring 65 to hold the top of the stack of spacers P against the feeding mechanism 70 pivotally mounted at one end in the top of the housing 60.

This feeding mechanism 70 may comprise a reciprocating claw 71 operated by an air cylinder 72 or by an electro-magnetic coil, which cylinder 72 is supported by a pivot 73 at the opposite end from its claw 71 at a point above the pivot 54 so that its reciprocating claw 71 is free to float and engage the top of the spacers P. Thus when the cylinder 72 is energized into its dotted line position 70', the claw 71 extends to push the spacer P' up in between the feeding and spacer shooting rollers 80.

At the oscillatible end of the shooter 60 above the pivot 57 there are provided a pair of rollers 81 and 82, the former and lower one of which is driven by an electric motor 83 at a relatively rapid rate. The upper roller 82 is an idler roller and is urged by springs 84 at its ends into contact with the driven roller 81. Thus as the spacer P' is fed by the claw 71 into and between the rollers 81 and 82, the fast rotating roller 81 grabs and pulls the spacer P' at such a speed so as to release it from the claw 71 and eject it outwardly through the open upper outer end 68 of the housing 60. There is also provided a guiding plate 67 inside the housing 61 for the spacer P' to direct its free ejected end in between the rollers 80 and 81.

Below the open oscillatible slotted end 68 of the shooter 80, there is preferably provided a light source 90 which may be adjustably mounted on pivot 91 for projecting a beam 92 directly against and into the angle $\alpha$ shown in FIG. I so that the operator at the slitter can readily see that the shooter 60 is moved into the right position and raised to the right angle for ejecting the spacer P. This is a particular advantage in view of the fact that underneath the strips S the albedo of the surface of the steel strip is very low, so that a light source is very helpful in insuring the accuracy of the positioning and operation of the shooting device 60 of this invention.

B-5. The Control Panel

Referring back to FIGS. I and II there is shown a control panel 100 which is preferably mounted adjacent the control panel for the operator of the slitter, wherever it might be, either on the slitter 12 or on the rewinding or recoiling device 20, which control panel 100 may comprise on and off buttons 101 and 102 respectively, with an indicating light 103, which buttons start the motor 83 for continuously operating the rollers 81 and 82, illuminate the light 90, and energize any hydraulic pumps or other mechanisms that may be used in controlling the other sources of power for operation of the boom 40, carriage 50 and shooter device 60.

Three reversing switches are also provided on the control panel 100, namely 104, 105 and 106, which respectively operate the motor 58 or mechanism 55 for raising and lowering the head of the shooter 60, for the motor 45 for moving the carriage 50 forward and backwardly along the boom 40, and finally switch 106 for operating the motor mechanism 35 for oscillating the boom 40 from its full line to its dotted line position as shown in FIG. II. There is also provided an additional pushbutton 107 for energizing the reciprocating motor 70 for feeding the top spacer P' into the shooting rollers 80 when the position of the shooter has been properly instigated. Thus, by pushing the button 107, the claw 71 ejects one spacer P at a time into the shooting rollers 80 for shooting it into the wrapped split coil SC' for reducing the sag of the strip S'. Then if the sag is not completely taken up with one spacer, another spacer is inserted therein by another push of the button 107.

Accordingly, the device 30 is substantially automatically operable by the operator of the splitter from one side of the splitter and out of danger of the rapidly moving coils CS and strips S.

While there are described above the principles of this invention in connection with specific apparatus, it is to be clearly understood that this description is made only by way of example and not as a limitation to the scope of this invention.

We claim:

1. In a coil slitter having a recoiling mandrel for a plurality of strips slit from a coil, a spacer shooter removably positioned between said slitter and said mandrel, comprising:

(A) a vertical post-type base located before said mandrel and adjacent one side of the plurality of strips slit from the coil, (B) a horizontal boom extending from said base under said strips, (C) means for oscillating said boom on said post base to a position away from under said strips, (D) carriage means movable on and along said boom, (E) means for moving said carriage along said boom, (F) a spacer shooter device pivotally mounting on said carriage, (G) means for raising and lowering said device about its pivot to direct its free end toward said winding coil on said mandrel, (H) beam means projecting outwardly from said device for indicating the coil strip and its periphery toward which said device is aimed, (I) storage means for a plurality of spacers in said device, and (J) means for shooting one spacer at a time from said storage means out of said device in the direction of said beam for insertion in the coil of the selected winding strip for taking up the slack in said strip between the slitter and the mandrel.

2. A shooter according to claim 1 including a coil unwinding mandrel spaced on the opposite side of said slitter from said strip winding mandrel.

3. A shooter according to claim 1 including means for controlling said oscillating means, said carriage positioning means, said raising and lowering means, and said shooting means.

4. A shooter according to claim 3 wherein said oscillating means, said carriage positioning means, said raising and lowering means, and said shooting means are all controlled by separate motor means.

5. A shooter according to claim 4 wherein each of said motor means is a reversible motor means.

6. A shooter according to claim 1 wherein said boom has track means for supporting said carriage means.

7. A shooter according to claim 1 wherein said carriage positioning means comprises a reversible worm means along said boom, and a nut mounted on said carriage engaging said worm.

8. A shooter according to claim 1 wherein said storage means has at least one resilient wall for urging said spacers toward said shooting means.

9. A shooter according to claim 1 wherein said storage means comprises a pair of opposite resilient walls for centering said spacers in said storage means.

10. In a coil slitter having a recoiling mandrel for a plurality of strips slit from a coil, a spacer shooter removably positioned between said slitter and said mandrel, comprising:

(A) a vertical post-type base located before said mandrel and adjacent one side of the plurality of strips slit from the coil, (B) a horizontal boom extending from said base under said strips, (C) means for oscillating said boom on said post base to a position away from under said strips, (D) carriage means movable on and along said boom, (E) means for moving said carriage along said boom, (F) a spacer shooter device pivotally mounting on said carriage, (G) means for raising and lowering said device about its pivot to direct its free end toward said winding coil on said mandrel, (H) beam means projecting outwardly from said device for indicating the coil strip and its periphery toward which said device is aimed, (I) storage means for a plurality of spacers in said device, and (J) means for shooting one spacer at a time from said storage means out of said device in the direction of said beam for insertion in the coil of the selected winding strip for taking up the slack in said strip between the slitter and the mandrel, said shooting means comprises a reciprocating claw for feeding the spacers from said storage means, and a pair of shooting rollers for engaging the spacer removed from said storage means and propelling it toward a strip coil.

11. A shooter according to claim 10 including means for rotating at least one of said rollers.

12. A spacer shooter for selecting one of a plurality of strips wound on a common mandrel having means for moving said shooter transversely of said strips and angularly with respect to the direction of movement of said strips, said shooter shooting one spacer at a time to be wound with said strip, the improvement comprising:

(A) a support located on the side of said strips and before said mandrel, (B) a boom pivoted on said support for oscillating movement between transversely and substantially parallel to said strips, (C) motor means for oscillating said boom, and (D) means for movably mounting said shooter on said boom.

13. A shooter according to claim 12 wherein said means for moving said shooter comprises separate motor means for moving said shooter along said boom and for moving said shooter angularly radially outwardly from the axis of said boom.

14. A shooter according to claim 12 wherein said boom includes track means for mounting said means for movably mounting said shooter.

15. A shooter according to claim 1 including control means remote from said shooter for controlling all the movements of said shooter and of said motor means for oscillating said boom.

16. A shooter according to claim 12 including a light source mounted on said shooter for indicating the strip coil to be tightened by insertion of a spacer.

* * * * *